US010746384B2

(12) United States Patent
Stucchi

(10) Patent No.: US 10,746,384 B2
(45) Date of Patent: Aug. 18, 2020

(54) LIGHTING APPARATUS, POWER-SUPPLY APPARATUS, COUPLING APPARATUS AND LIGHTING SYSTEM

(71) Applicant: A.A.G. Stucchi S.r.l., Olginate (IT)

(72) Inventor: Aristide Stucchi, Lecco (IT)

(73) Assignee: A.A.G. STUCCHI S.R.L., Olginate (LC) (IT)

( * ) Notice: Subject to any disclaimer, the term of this patent is extended or adjusted under 35 U.S.C. 154(b) by 0 days.

(21) Appl. No.: 16/210,742

(22) Filed: Dec. 5, 2018

(65) Prior Publication Data

US 2019/0170334 A1 Jun. 6, 2019

(30) Foreign Application Priority Data

Dec. 6, 2017 (IT) ..... 102017000141232

(51) Int. Cl.
*F21V 21/35* (2006.01)
*F21V 23/06* (2006.01)
(Continued)

(52) U.S. Cl.
CPC ..... *F21V 21/35* (2013.01); *F21S 8/038* (2013.01); *F21V 21/096* (2013.01); *F21V 23/06* (2013.01); *F21S 2/005* (2013.01); *F21V 23/023* (2013.01)

(58) Field of Classification Search
CPC ..... F21V 21/35; F21V 21/096; F21V 23/06; F21V 23/023; F21V 19/00;
(Continued)

(56) References Cited

U.S. PATENT DOCUMENTS 3,825,879 A 7/1974 Hesse
4,475,226 A * 10/1984 Greenberg ..... F21V 33/0056 362/370
(Continued)

FOREIGN PATENT DOCUMENTS

CN 206592940 U 10/2017
DE 2210516 A1 9/1973
(Continued)

OTHER PUBLICATIONS

Search Report and Opinion, Jesus Soto Salvador, The Hague, dated May 3, 2018.
(Continued)

*Primary Examiner* — Bao Q Truong
(74) *Attorney, Agent, or Firm* — Florek & Endres PLLC

(57) ABSTRACT

The lighting apparatus (10) comprises a connection body (11), and a lighting body (12) with at least one light source (13); the lighting body (12) is mechanically and electrically connected to the connection body (11), the connection body (11) is adapted to be mechanically and electrically connected to a supporting and power-supply guide (20) which extends in a longitudinal direction (L); the connection body (11) is shaped like an elongated box and is adapted to be inserted into and extracted from the guide (20) at least in a direction (P) perpendicular to the length thereof and to the longitudinal direction (L); the connection body (11) comprises at least two mechanical contacts (16A, 16B) and at least two electrical contacts (15A, 15B), as well as at least two elastic means which act on the mechanical contacts (16A, 16B) or on the electrical contacts (15A, 15B) so as to allow them to be moved back-and-forth during the inserting and extracting step into/from said guide (20).

20 Claims, 11 Drawing Sheets

(51) Int. Cl.

| | |
|---|---|
| ***F21V 21/096*** | (2006.01) |
| ***F21S 8/00*** | (2006.01) |
| *F21S 2/00* | (2016.01) |
| *F21V 23/02* | (2006.01) |

(58) Field of Classification Search
CPC ..... F21V 19/00035; F21V 19/0015; F21V 19/0025; F21V 19/0045; F21V 19/007; F21V 19/004; F21V 19/0065; F21V 19/0085; F21S 8/038; F21S 2/005
See application file for complete search history.

(56) References Cited

U.S. PATENT DOCUMENTS 8,876,336 B2 * 11/2014 Suzuki ..... F21V 19/0025 362/311.02
9,958,114 B2 * 5/2018 Park ..... F21S 2/00
2005/0254262 A1 * 11/2005 Chiu ..... A47F 11/10 362/648
2009/0279298 A1 * 11/2009 Mier-Langner ..... F21V 21/096 362/235
2015/0079824 A1 3/2015 Dinnebier et al.
2015/0226384 A1 8/2015 Park
2019/0132928 A1 * 5/2019 Rodinger ..... F21S 2/005

FOREIGN PATENT DOCUMENTS

| | | | |
|---|---|---|---|
| DE | 2513392 | A1 | 9/1976 |
| DE | 9301559 | U1 | 5/1993 |
| GB | 2021877 | A | 12/1979 |
| WO | 2013128385 | A1 | 9/2013 |

OTHER PUBLICATIONS

Communication Pursuant to Rule 114(2) EPC, European Patent Office, May 12, 2020.

* cited by examiner

LIGHTING APPARATUS, POWER-SUPPLY APPARATUS, COUPLING APPARATUS AND LIGHTING SYSTEM

FIELD OF THE INVENTION

The present invention relates to a lighting apparatus, a power-supply apparatus, a coupling apparatus and a lighting system.

Background Art

In the lighting field, there are many solutions for mechanically fixing and electrically connecting lighting apparatuses.

One of these is based on the so-called "electrified rails". An "electrified rail" is a guide which extends longitudinally (e.g. for a length of 100 cm), which is adapted to be fixed, e.g. to a ceiling or a wall of a room, and which is adapted to receive a connection body of a lighting fixture in a longitudinal groove thereof; in general, a guide can provide mechanical support and electrical power supply to one or several apparatuses; in general, an apparatus may be positioned at any point along a guide and can be moved or removed afterwards.

According to a typical known solution, the connection body of the lighting apparatus is shaped as an elongated box (e.g. 20 cm long), and is adapted to be inserted into and extracted from the groove of the guide. For the mechanical and electrical connection between body and guide, the body is provided with mechanical and electrical contacts which are adapted to be moved manually; in particular, by means of a first manual maneuver (e.g. performed by means of an appropriate tool) both the electrical contacts and the mechanical contacts assume a protruding position from the surface of the body and by means of a second manual maneuver (e.g. performed by means of an appropriate tool) both the electrical contacts and the mechanical contacts assume a position inside the body. Therefore, before inserting the body into the guide, the contacts must be manually placed in the internal position (second maneuver); then, the body is fitted in the guide, which does not require applying any force to the body; finally, the contacts must be moved manually into the protruding position (first maneuver); thereby, the mechanical contacts of the body cooperate with the guide and provide mechanical support to the apparatus and the electrical contacts of the body cooperate with the guide and provide electrical power supply to the apparatus. It is necessary to reverse the procedure in order to move or remove the apparatus.

In general, the manual maneuvers for positioning, removing and moving the apparatus are awkward. In given positioning conditions of the guide and/or of the lighting apparatus (e.g. when the guide is in a corner of a room and/or the lighting apparatus must be positioned in corner of a room), such maneuvers are particularly awkward.

Furthermore, the mechanisms of the connection body of the lighting apparatus which are used to move contacts contribute to its complexity and its cost.

Finally, the need to perform manual maneuvers (with or without tool) poses constraints regarding the shape and size of the guides and/or of the lighting apparatuses.

Document US 2015/226384 A1 discloses a lighting system with power-supply guide. According to this solution, one end of the connection body is disengaged from the guide and then the body is rotated to complete the disengagement (Cf. for example FIG. 10).

Document GB 2021877 A discloses a lighting system with power-supply guide. According to this solution, one end of the connection body is disengaged from the guide and then the body is rotated to complete the disengagement; in order to perform these operations, pyramid-shaped protruding teeth are used (Cf. for example tooth 12 with surfaces 13, 14, 15 in FIG. 1).

Document DE 2513392 A1 discloses a lighting system with power supply guide. According to this solution, the insertion of the connection body in the guide is achieved not only by pushing the body against the guide, but also by manually pressing buttons to retract the protruding teeth (Cf. buttons 56 and teeth 52 in the figures).

Document CN 20659240 U discloses a lighting system with power-supply guide. According to this solution, the insertion of the connection body in the guide is achieved not only by pushing the body against the guide, but also by manually pressing a button to retract the protruding teeth (Cf. button 4 and teeth 5 in the figures).

Document U.S. Pat. No. 3,825,879 A discloses a lighting system with power supply guide. According to this solution, the connection body is inserted in the guide in a direction parallel to the length of the body and to the longitudinal direction of the guide.

Document DE 2210516 A1 discloses a lighting system with power supply guide. According to this solution, the insertion of the connection body in the guide is achieved not only by pushing the body against the guide, but also by manually rotating a shaped element (Cf. for example FIG. 8 and FIG. 9).

SUMMARY

It is a general object of the present invention to improve the prior art from one or more points of view.

Such an object is substantially achieved by virtue the description found in the appended claims, which form an integral part of the present description.

Underlying the present invention is the idea of associating elastic means with the (mechanical and/or electrical) contacts so that they can move automatically back-and-forth when the connection body of the lighting apparatus is inserted into and extracted from the guide; in other words, the back-and-forth movement is an effect of manual push of the body towards the guide during the inserting step and of the manual pulling of the body from the guide during the extracting step and does not require further manual maneuvers with or without tool. Thereby, the connection body is adapted to be inserted into and extracted from the guide in a direction perpendicular to its length and to the longitudinal direction of the guide; this does not preclude insertion and/or extraction in different directions.

LIST OF DRAWINGS

The present invention will become more apparent from the following detailed description to be considered in conjunction with the accompanying drawings, in which:

FIG. 1 shows a very diagrammatic longitudinal view of a lighting apparatus and of a guide according to the present invention, FIG. 2 shows a very diagrammatic cross-section view of the apparatus and of the guide of FIG. 1, FIG. 3 shows a diagrammatic cross-section view of a lighting apparatus and a guide according to the present invention, FIG. 4 shows a diagrammatic cross-section view of a guide according to the present invention alternative to that shown in FIG. 3, FIG. 5 shows a very diagrammatic view of a lighting apparatus according to the present invention, FIG. 6 shows detailed cross-section views according to the present invention;

FIG. 7 refers to a particular embodiment of the present invention and shows a cross-section view of a guide;

As clearly apparent, the present invention, the main advantageous aspects of which are defined in the appended claims, and which are not limited either by the detailed description which follows or by the accompanying drawings, can be implemented in various manners.

DETAILED DESCRIPTION

Figures 1, 2:
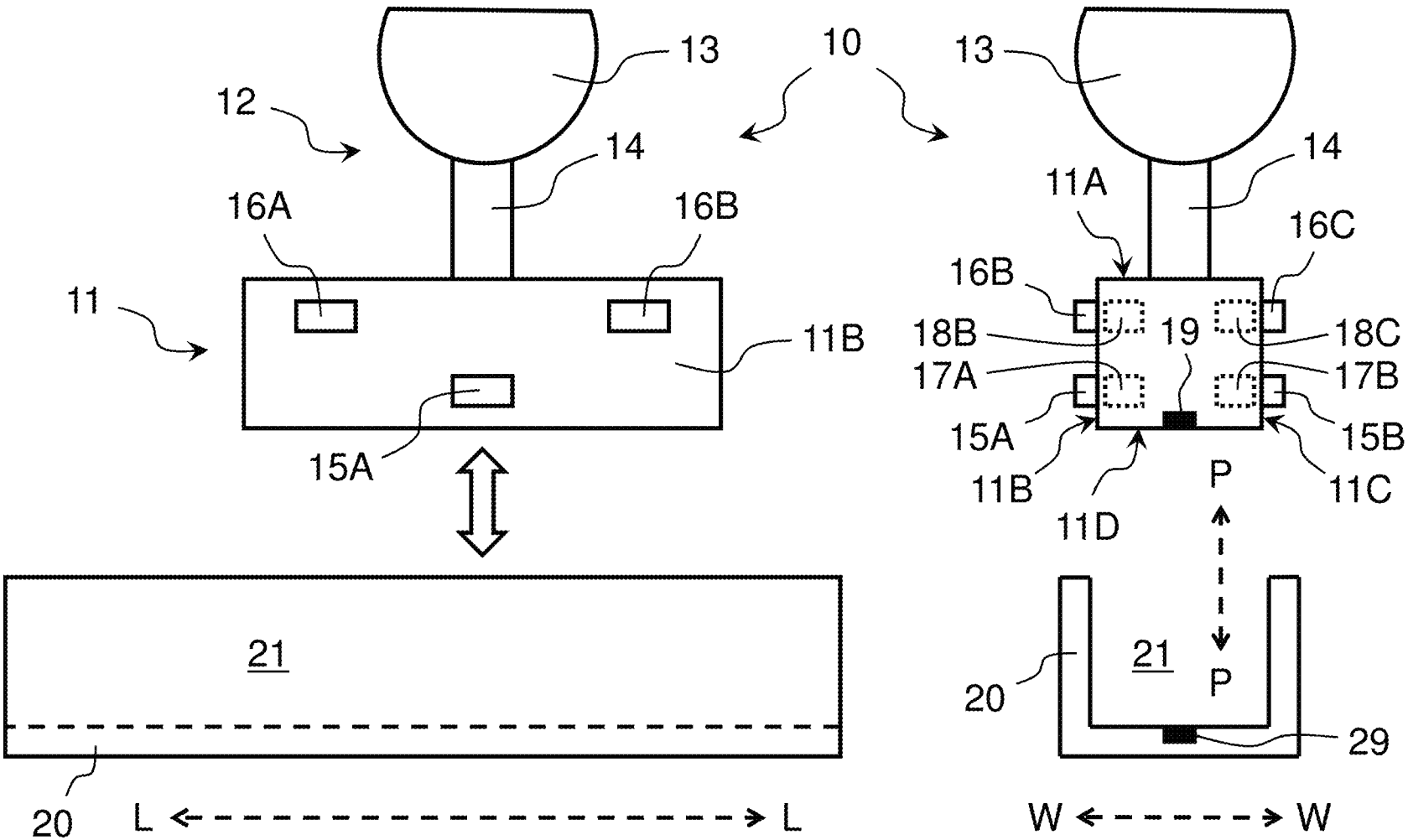

FIG. 1 and FIG. 2 show a lighting apparatus 10 and a guide 20 adapted to cooperate in a very diagrammatic manner.

The apparatus 10 comprises: a connection body 11 and a lighting body 12; the lighting body 12 comprises at least a light source 13 and a supporting element 14 mechanically fastened between them.

The lighting body 12 is mechanically and electrically connected to the connection body 11. In particular, as regards the mechanical connection, the element 14 can be screwed into a hole of the body 11. In particular, as regards the electrical connection, there may be two electrical conductors which exit from the body 11 and enter into the body 12; they extend into the element 14 and end at the light source 13.

It is worth noting that, according to the present invention, the lighting body may have various shapes and sizes. According to a very typical possibility, the lighting body has the shape of an elongated box and contains, for example, a plurality of LEDs; in particular, the length of the lighting body (e.g. 50-100 cm) may be far greater than the length of the connection body (e.g. 10-20 cm).

The connection body 11 is adapted to be mechanically and electrically connect to a supporting and power-supply guide 20 which extends in a longitudinal direction L.

The connection body 11 is shaped as an elongated box and is adapted to be inserted into and extracted from the guide 20 at least in a direction P perpendicular to the longitudinal direction L (see the two-way arrow in FIG. 1). The guide typically has a longitudinal groove 21; such a groove is preferably sized so as to accommodate the body 11 completely; in particular, the depth of the groove 21 corresponds exactly to the height of the body 11.

The possibility of inserting and extracting the connection body in direction perpendicular to the direction of extension of the guide, as well as to the length of the connection body (i.e. these insertion and extraction operations can also occur keeping body and guide parallel to each other and therefore without mutual rotations), is very advantageous because it makes both the positioning of the guide and the positioning and removal of lighting apparatuses, as well as the shape and size of the lighting apparatuses, totally free.

The connection body 11 comprises at least two mechanical contacts (in particular, on opposite sides) and at least two electrical contacts (either on the same side or on different sides); the electrical contacts are used to receive electrical power supply for the light source 13 when they abut on the electrical conductors of a guide (e.g. the guide 20); the mechanical contacts are used to attach (in removable manner) the body to a guide (e.g. the guide 20) when they abut on the internal surfaces of the guide, in particular the side surfaces of one of an internal groove thereof (e.g. the groove 21).

According to a preferred embodiment, the two mechanical contacts are respectively associated with two elastic means, and the two electrical contacts are respectively associated with two elastic means.

In the example in FIG. 1 and FIG. 2, there are four mechanical contacts 16A, 16B, 16C, 16D, and two electrical contacts 15A, 15B; contact 16D is not visible in the figures because it is hidden.

According to the present invention, at least two elastic means are provided which act on the two mechanical contacts or on the two electrical contacts so as to allow their back-and-forth movement both during the step of inserting into a guide (e.g. the guide 20) and in the step of extracting from a guide (e.g. the guide 20). The retraction and the advancement of the contacts occurs, in particular, precisely by effect of the insertion and extraction; in other words, the mechanical connection and electrical connection does not require other manual maneuvers than the insertion (precisely, the manual pushing of the body towards the guide) and the mechanical disconnection and the electrical disconnection do not require other manual maneuvers than the extraction (precisely, the manual pulling of the body from the guide). In the example of FIG. 1 and FIG. 2, the back-and-forth movements are in direction W (corresponding to the width of the apparatus 10 and of the guide 20) and the insertion and extraction are in direction P (corresponding to the height of the apparatus 10 and of the guide 20), i.e. in two mutually orthogonal directions; direction L (corresponding to the length of the apparatus 10 and of the guide 20) is perpendicular to direction P and to direction W.

The use of the elastic means is very advantageous because it allows displacing the lighting apparatuses without mechanically decoupling them (and even without electrically decoupling them) from the guides.

An elastic means can be, for example, a helical spring, but it can also be made otherwise.

Although, according to the present invention, it is preferable to provide elastic means for the back-and-forth movement of all contacts (both the mechanical and the electrical ones), it cannot be excluded that manual actuation mechanisms may be used for the back-and-forth movement of some contacts according to some embodiments based, for example, on the pushing of a button or on the rotation of a knob or a screw.

In the example of FIG. 1 and FIG. 2, there are six elastic means 17A, 17B, 18A, 18B, 18C, 18D (the means 18A and 18D are not visible in the figures because they are hidden): two means 17A, 17B respectively for the two electrical contacts 15A, 15B and four means 18A, 18B, 18C, 18D respectively for the four mechanical contacts 16A, 16B, 16C, 16D.

According to a preferred embodiment, an elastic means and a mechanical contact may be integrated so as to form a mechanical contact device. Such a device may be, for example, a shaped elastic tongue made of plastic material.

According to a preferred embodiment, an elastic means and an electrical contact may be integrated so as to form an electrical contact device. Such a device may be, for example, a shaped elastic tongue made of metallic material.

It is possible for a mechanical contact and an electrical contact to be integrated so as to form a single contact with a both mechanical and electrical function; in this case, it is particularly important to choose the elastic force which acts on the single contact for it to well implement both the mechanical connection function and the electrical connection function. It is worth noting that an electrical contact may always be considered a mechanical contact even if it achieves the function of mechanical connection either slightly or not at all.

Typically, and preferably, the contacts are located on the sides of the connection body. In the example of FIG. 1 and FIG. 2, the contacts 15A, 15B, 16A, 16B, 16C, 16D are located on the sides 11B and 110 of the body 11. Preferably, a first mechanical contact (e.g. the contacts 16A and 16B) is located on a first side (e.g. 11B) of the body 11, and a second mechanical contact (e.g. 16C and 16D) is located on a second side (e.g. 110) of the body 11.

According to an embodiment alternative to that in FIG. 1 and FIG. 2, it is possible to provide, for example, four electrical contacts, first two electrical contacts may be adapted to receive electrical power supply and second two electrical contacts may be adapted to receive electrical control signals.

The connection body (e.g. 11) may comprise a magnet (e.g. 19) located preferably at a back (e.g. 11D) of the body (e.g. 11). The magnet is a mechanical connection means of the apparatus (e.g. 10) to the guide (e.g. 20) which is optionally added to the mechanical contacts; the guide may be provided, for example, with a strip of magnetic material (e.g. 29) adapted to cooperate with the magnet of the connection body.

Typically, the lighting body (e.g. 12) can be connected mechanically and electrically to the connection body (e.g. 11) at a front (e.g. 11A) of the connection body (e.g. 11).

Figure 3:
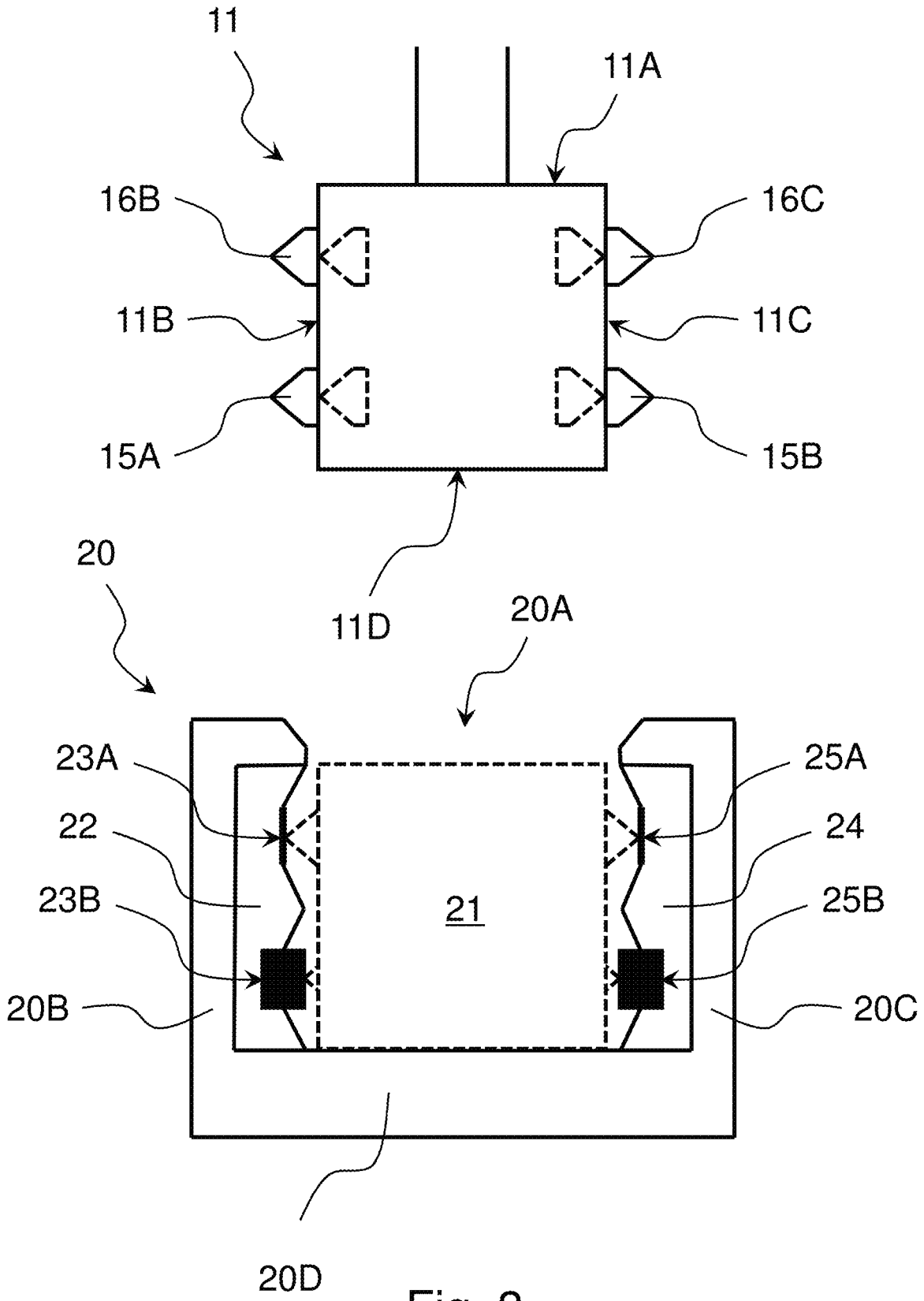

FIG. 3 shows a possible embodiment of the body 11 and of the guide 20 in greater detail with respect to FIG. 1 and FIG. 2, so as to better understand how a connection body according to the present invention can cooperate with a supporting and power-supply guide.

The upper part of FIG. 3 shows the connection body 11 with two electrical contacts 15A and 15B (on sides 11B and 11C, respectively) and with two mechanical contacts 16*b* and 16C (on sides 11B and 110, respectively); the contacts are drawn with a solid line in their (most) protruding position and with dashed line in their non-protruding position, i.e. (most) internal position.

The lower part of FIG. 3 shows the guide 20 with the groove 21. The guide has a back wall 20D, a first side wall 20B, a second side wall 20C and a front zone 20A at the opening of the groove 21.

The guide also comprises a first insert 22 adjacent to the wall 20B and provided, for example, with a mechanical abutment surface 23A and an electrical conductor 23B, and a second insert 24 adjacent to the wall 20C and provided, for example, with a mechanical abutment surface 25A and an electrical conductor 25B; the abutment surfaces and electrical conductors extend, for example, for the entire length of the guide 20.

The insert 22 comprises a strip of electrically insulating material, e.g. with a first recess (near the front zone 20A), in which the mechanical abutment surface 23A is located, and a second recess (close to the wall of the back 20D), in which the electrical conductor 23B (protruding from the recess) is fixed.

The insert 24 comprises a strip of electrically insulating material, e.g. with a first recess (near the front zone 20A), in which the mechanical abutment surface 23A is located, and a second recess (close to the wall of the back 20D), in which the electrical conductor 25B (protruding from recess) is fixed.

It is worth noting that in the embodiment of FIG. 3, the electrical conductors 23B and 25B are well exposed, i.e. are not sunk into the recesses, therefore it is sufficient for the electrical contacts 15A and 15B of the connecting body 11 to perform a small retraction and a small advancement during the inserting and extracting step. The fact that it is possible to touch the electrical conductors 23B and 25B by inserting a finger in the groove 21 is not a problem when the guide 20 is used for very low voltage lighting apparatuses, e.g. voltages lower than 60 volts. The electrical conductors 23B and 25B can be, for example, made of an inexpensive metallic material, such as copper; indeed, being positioned on the sides of the guide 20 they are hardly visible from the outside, although not sunk. Naturally, they may be made of graphite, for example, whereby being invisible from the outside.

The lower part of FIG. 3 shows with a dashed line the connection body 11 when it is fully inserted into the groove 21 of the guide 20. It is worth noting that the contacts 15A, 15B, 16B, 16C are slightly retracted with respect to their most protruding position and abut against the elements 23A, 23B, 25A, 25B; the elastic means associated with the contacts make the contacts 15A, 15B, 16B, 16C apply a force in transverse side direction (in particular parallel to direction W) to the elements 23A, 23B, 25A, 25B and then to the strips 22 and 24 and then to the walls 20B and 20C of the guide 20.

It is worth noting that the electrical contacts 15A and 15B provide electrical coupling when they cooperate with the electrical conductors 23B and 25B of the guide 20 and can also contribute to the mechanical coupling.

As shown in FIG. 3, the contacts of the connection body and/or the recesses of the guide have inclined surfaces. In this manner, when the connection body moves towards or away from the guide and goes in contact with the components of the guide, the contacts tend to move (automatically, i.e. without any further manual maneuvers with or without tool) in direction perpendicular to this direction (i.e. they retract); this movement of the contacts is contrasted by the elastic means; therefore, in order to proceed with the movement, it is necessary to apply a force to the body in the back-and-forth direction either towards or away from the guide. The elastic means tend to return the contacts to the protruding position (automatically, i.e. without any further manual maneuvers with or without tool).

With reference to FIG. 3, for example, when the body 11 is approached to the guide 20 causing it to descend vertically and apply a force directed toward the guide 20, the following steps occur in sequence:

a) retraction (total) (automatic) of the contacts 15A and 15B
b) advancement (partial) (automatic) of the contacts 15A and 15B
c) retraction (total) (automatic) of the contacts 15A and 15B and of the contacts 16*b* and 16C
d) advancement (partial) (automatic) of the contacts 15A and 15B and of the contacts 16*b* and 16C The image shown on the bottom of FIG. 3 corresponds to the end of ep "d" when the back 11D of the body 11 abuts against the wall of the back 20D of the guide 20.

Figure 4:
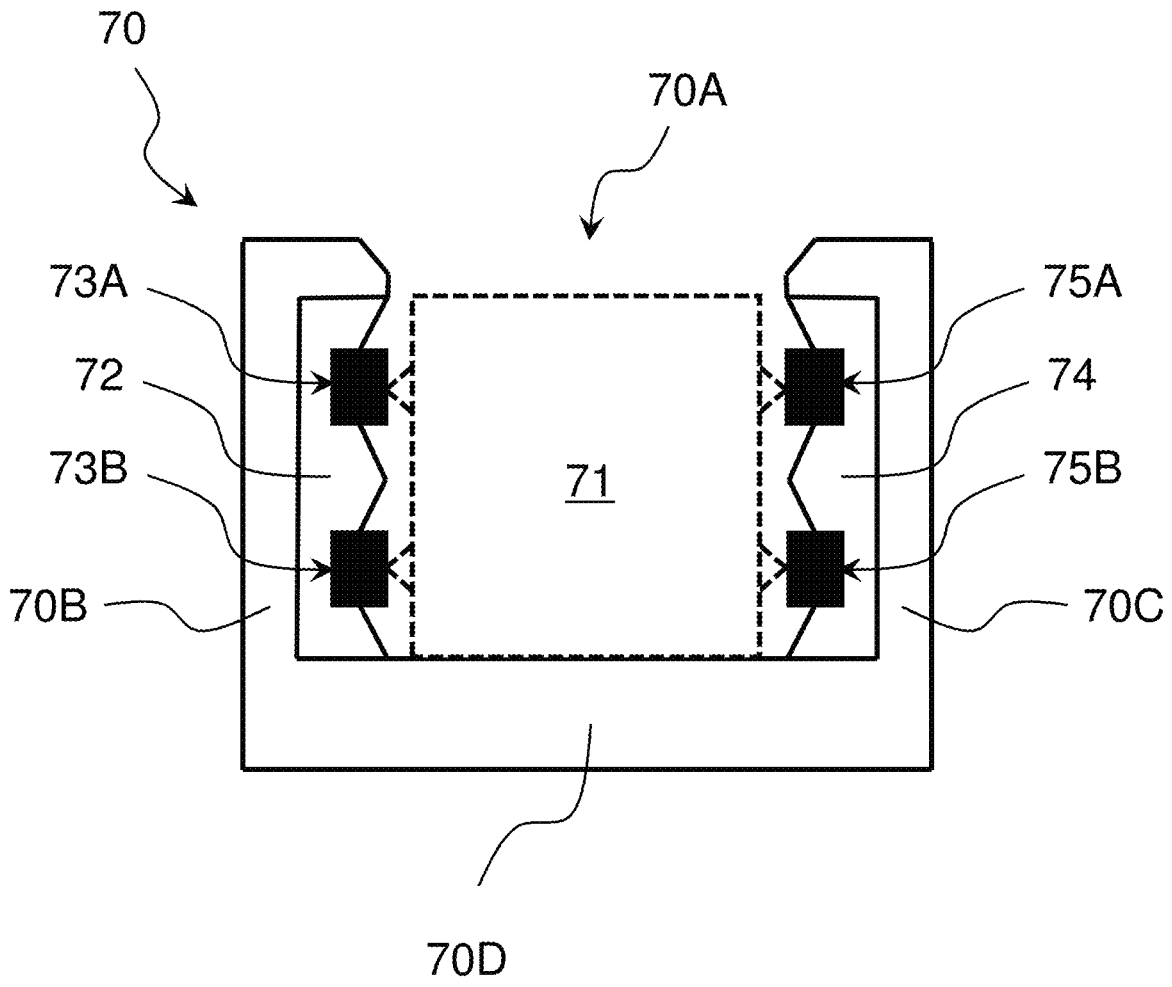

FIG. 4 shows a guide 70 alternative to the guide 20 in FIG. 3 and adapted to cooperate with a connection body equipped with four electrical contacts.

The guide has a back wall 70D, a first side wall 70B, a second side wall 70C and a front zone 20A at the opening of a groove 71.

The guide further comprises a first insert 72 adjacent to the wall 70B and equipped with two electrical conductors 73A and 73B, and a second insert 74 adjacent to the wall 70C and equipped with two electrical conductors 75A and 75B; the electrical conductors extend, for example, for the entire length of the guide 70.

The insert 72 comprises a strip of electrically insulating material, e.g. with a first recess (near the front zone 70A), in which the electrical conductor 73A (protruding from the recess) is fixed and a second recess (close to the back wall 70D), in which the electrical conductor 73B (protruding from the recess) is fixed.

The insert 74 comprises a strip of electrically insulating material, e.g. with a first recess (near the front zone 70A), in which the electrical conductor 75A (protruding from the recess) is fixed and a second recess (close to the back wall 70D), in which the electrical conductor 75B (protruding from the recess) is fixed.

It is worth noting that in the embodiment of FIG. 4, the electrical conductors 73A, 73B, 75A and 75B are well exposed, i.e. are not sunk into the recesses, therefore it is sufficient for the electrical contacts of the connecting body to make a small retraction and a small advancement during the inserting and extracting step. The fact that it is possible to touch the electrical conductors 73A, 73B, 75A and 75B by inserting a finger in the groove 71 is not a problem when the guide 70 is used for very low voltage lighting apparatuses, e.g. voltages lower than 60 volts. The electrical conductors 73A, 73B, 75A and 75B can be, for example, made of inexpensive metallic material, such as copper; indeed, being positioned on the sides of the guide 70 they are hardly visible from the outside, although not sunk. Naturally, they may be made of graphite, for example, whereby being invisible from the outside.

FIG. 4 shows with a dashed line a connection body when it is fully inserted in the groove 71 of the guide 70. It is worth noting that the four electrical contacts are the body are retracted with respect to their most protruding position and abut against the electrical conductors 73A, 73B, 75A and 75B; the elastic means associated with the electrical contacts make the electrical contacts apply a force in transverse side direction (in particular parallel to direction W) to the electrical elements 73A, 73B, 75A and 75B and then to the strips 72 and 74 and then to the walls 70B and 70C of the guide 70.

It is worth noting that the electrical contacts provide electrical coupling when they cooperate with the electrical conductors 73A, 73B, 75A and 75B of the guide 70 and can also contribute to the mechanical coupling. In the embodiment of FIG. 4, the mechanical coupling may be provided, for example, mainly by mechanical contacts (not shown in the figure) and/or by magnetic means (not shown in the figure).

As shown in FIG. 4 and similarly to FIG. 3, the contacts of the connection body and/or the recesses of the guide have inclined surfaces.

Figure 5:
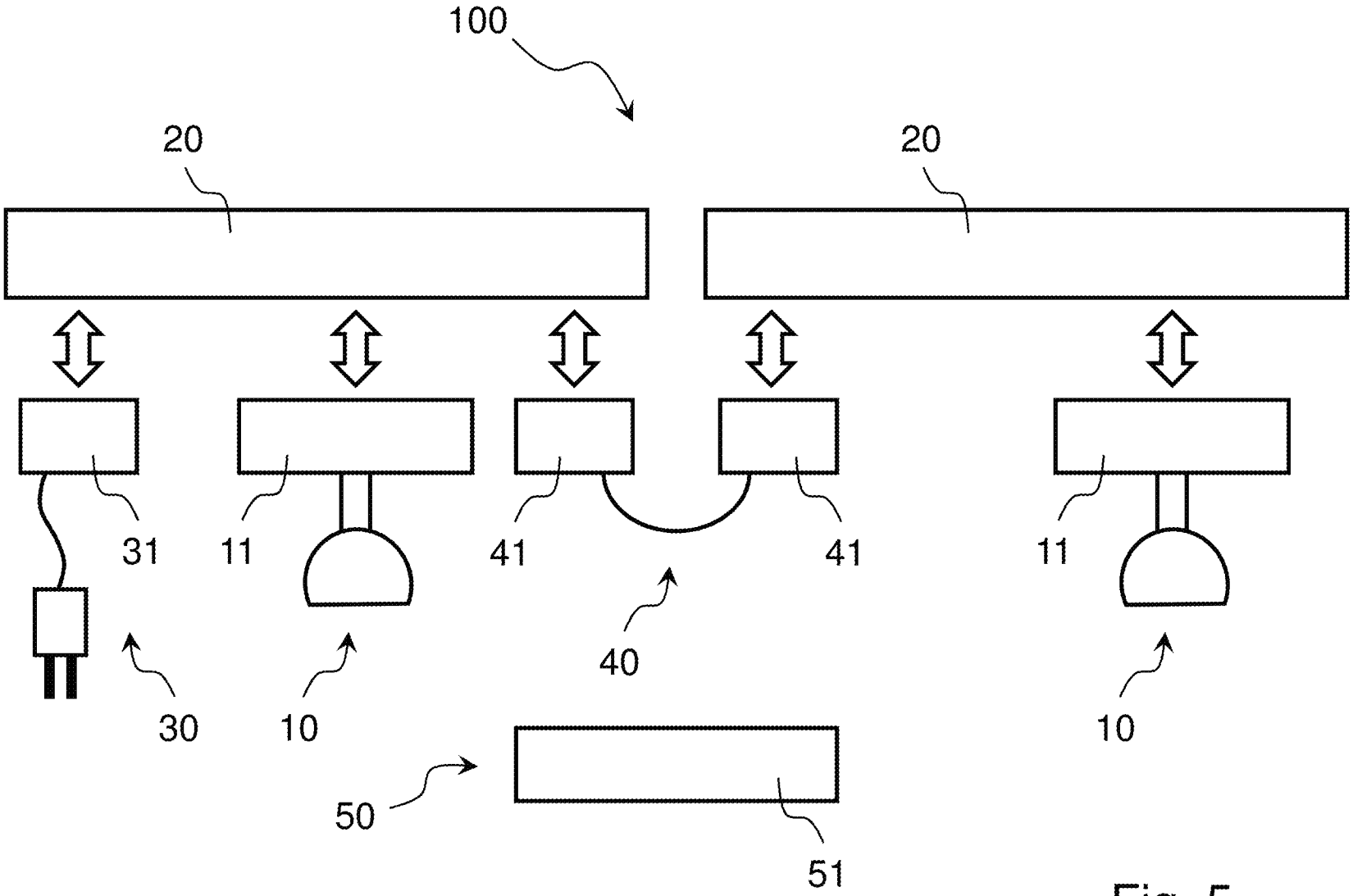

An example of embodiment of a lighting system 100 according to the present invention is diagrammatically shown in FIG. 5.

The system 100 of FIG. 5 comprises seven components. In general, the number of components can vary from a minimum of three to an undefined maximum. The three minimum components are: a supporting and power-supply guide (e.g. adapted to be fixed to a ceiling or a wall of a room), a lighting device and a power-supply apparatus (component which will be illustrated below).

The system (100) comprises: two supporting and power-supply guides 20 (the same reference as FIG. 1 and FIG. 2 is used here to indicate that they may be like those shown in these figures), two lighting apparatuses 10 (the same reference as FIG. 1 and FIG. 2 is used here to indicate that they may be like those shown in these figures), a power-supply apparatus 30 and two coupling apparatuses 40. Instead of the two coupling apparatuses 40, there may be only one coupling device 50.

All apparatuses, 10, 20, 30, 40 and 50 comprise a similar connection body 11, 21, 31, 41, 51, which is adapted to be inserted into the groove 21 of the guides 20 to achieve provide mechanical and electrical connection with them.

Substantially, the power-supply apparatus 30 applies electrical power to electrical conductors of one of the two guides 20, the lighting apparatuses 10 draw electrical power supply from the electrical conductors of the guides 20, one of the two coupling apparatuses 40 draws electrical power from the electrical conductors of one of the two guides 20 and transmits it to an electrical wire (provided with at least two electrical conductors), and the other of the two coupling apparatuses 40 receives electrical power supply from the electrical wire and applies it to the electrical conductors of the other of the two guides 20. When the coupling apparatus 50 is present, the transfer of electrical power from one guide to the other guide occurs via electrical conductors inside the coupling apparatus.

The power-supply apparatus 30 comprises a connection body 31 which contains an electrical power supply unit adapted to be electrically connected to an electrical supply network (in FIG. 4, this is diagrammatically indicated by the symbol of a plug with wire); the electrical power supply unit may, for example, provide a transformation from 220 VAC at 48 VDC.

Furthermore, in the examples of embodiment in which control electrical signals are transmitted by means of the guides, the connection body 31 further contains an electronic unit adapted to generate said electrical control signals.

The body 31 of the apparatus 30 is similar to the body 11 of the apparatus 10. Therefore, it displays one or more of the technical features described above in relation to the body 11, in particular as regards mechanical contacts, the electrical contacts and the elastic means.

The coupling apparatus 40 comprises a connection body 41 with many electrical conductors for transferring electrical power supply and/or electrical control signals; in particular, the apparatus 40 includes internal electrical conductors and a wire, with corresponding external electrical conductors, for the electrical connection with another coupling apparatus; alternatively, a coupling apparatus could comprise internal electrical conductors and two (or more) wires, with corresponding external electrical conductors, for the electrical connection to the other two (or more) coupling apparatuses.

Instead, the coupling apparatus 50 comprises only internal electrical conductors.

It is worth noting that the coupling apparatus 50 achieves not only an electrical coupling, but also a mechanical coupling since it mechanically connects with two guides.

The bodies 41 and 51 of apparatuses 40 and 50 are similar to the body 11 of the apparatus 10. Therefore, they display one or more of the technical features described above in relation to the body 11, in particular as regards mechanical contacts, the electrical contacts and the elastic means.

It is worth noting that by virtue of the technical characteristics of the present invention, in particular of the use of elastic means for both mechanical and electrical coupling, the external shape of the guides may be totally independent from their internal shape. In other words, once the shape and the size of the internal groove of the guide is chosen, since the mechanical and electrical coupling with the lighting apparatuses is very simple and does not require any particular spaces or special tools, the external shape and external sizes of the guide may be of any type, e.g. dictated by choices in lighting and/or appearance requirements.

Figure 6:
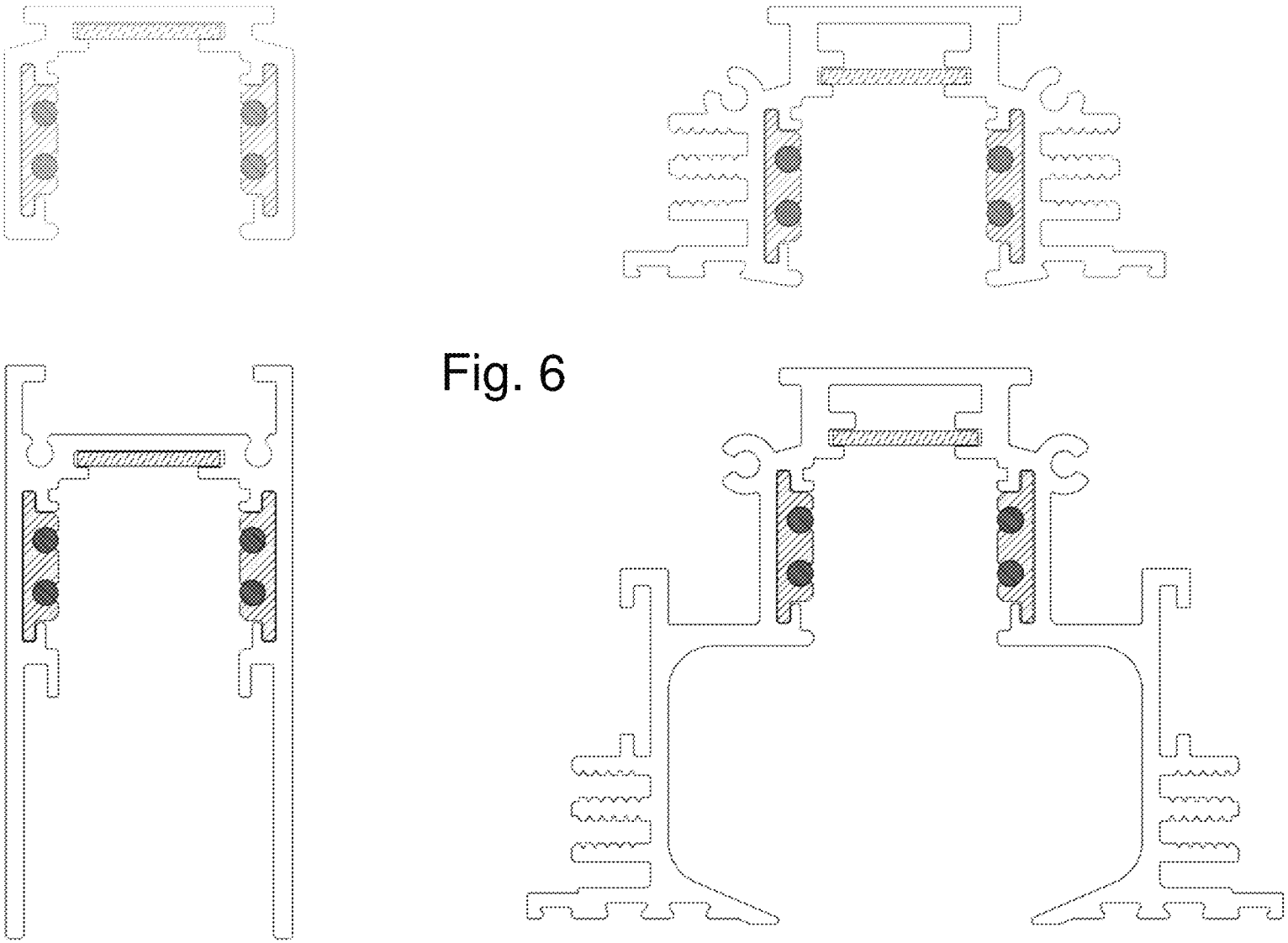

FIG. 6 shows a section view of four different guides according to the present invention with a mutually very different external shape, but with exactly the same shape and size of the internal groove. This means that a same lighting apparatus, a same power-supply apparatus and a same coupling apparatus can cooperate electrically and mechanically, for example with these four guides; this is a great advantage from industrial and commercial the point of view.

The guides of FIG. 6 are adapted to apparatuses with four electrical contacts and two (or more) mechanical contacts; they have two small internal grooves located laterally in their front zone (on the bottom of the four images of FIG. 6) adapted to cooperate with mechanical contacts of the apparatuses.

These guides can be made by simple extrusions or co-extrusions.

A particularly advantageous example of embodiment of the present invention will be described with reference to figures FIG. 7 to FIG. 12. It is worth noting that this embodiment has many technical characteristics in combination; however, this combination must not be understood in restrictive sense, and therefore alternative embodiments may display only one or more or all of these technical features.

Figure 7:
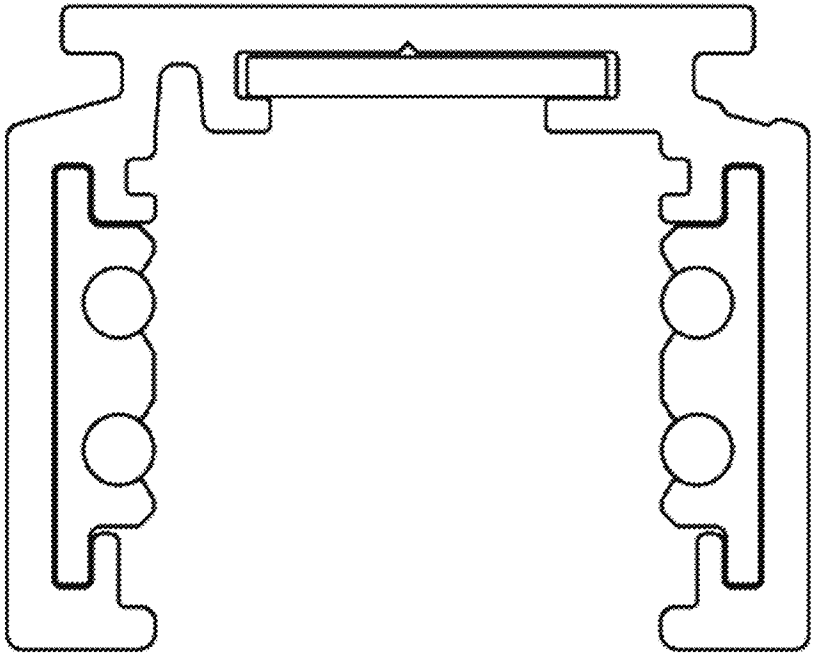

As can be seen, FIG. 7 corresponds exactly to one of the guides of FIG. 6 and diagrammatically corresponds to the guide 20 of FIG. 3 (structurally and functionally); in particular, this is a guide the electrical conductors of which can conduct and provide a very low voltage to the connection body, e.g. voltages lower than 60 volts and therefore are well exposed, i.e. not sunk into recesses.

The connection body shown in FIG. 8 and FIG. 9 and FIG. 10 can be coupled to any one of the guides of FIG. 6, but in the following description it is considered adapted to be coupled to the guide in FIG. 7; it diagrammatically corresponds to the body 11 of FIG. 3 (structurally and functionally).

Figure 8:
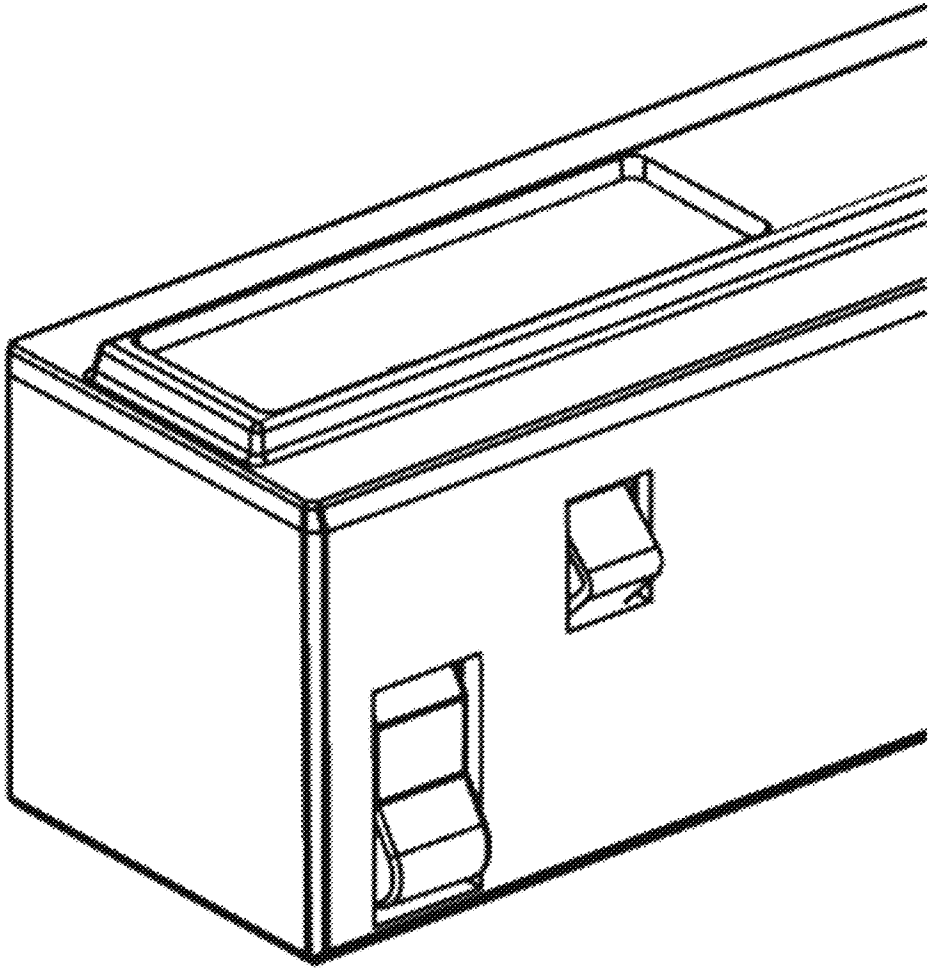
FIG. 8 shows a partial three-dimensional view of a particular embodiment of the present invention.
Figure 9:
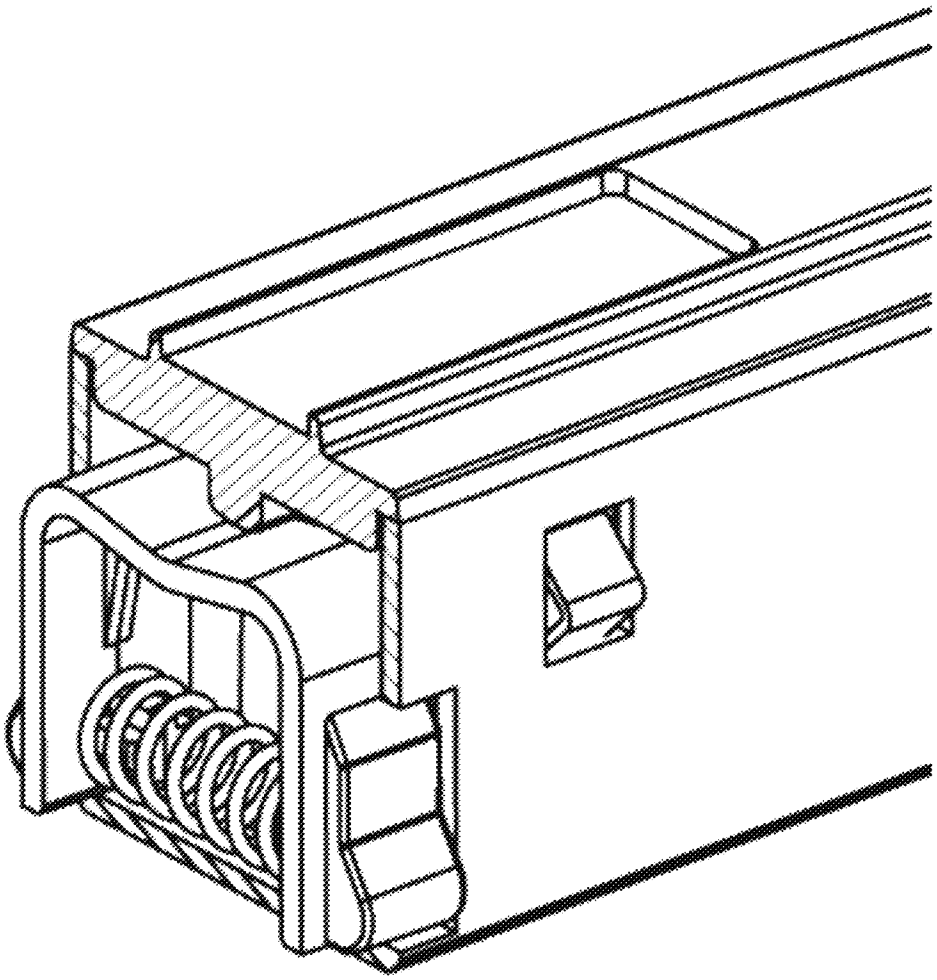
FIG. 9 shows a first three-dimensional view in partial cross-section of the example of FIG. 8.
Figure 10:
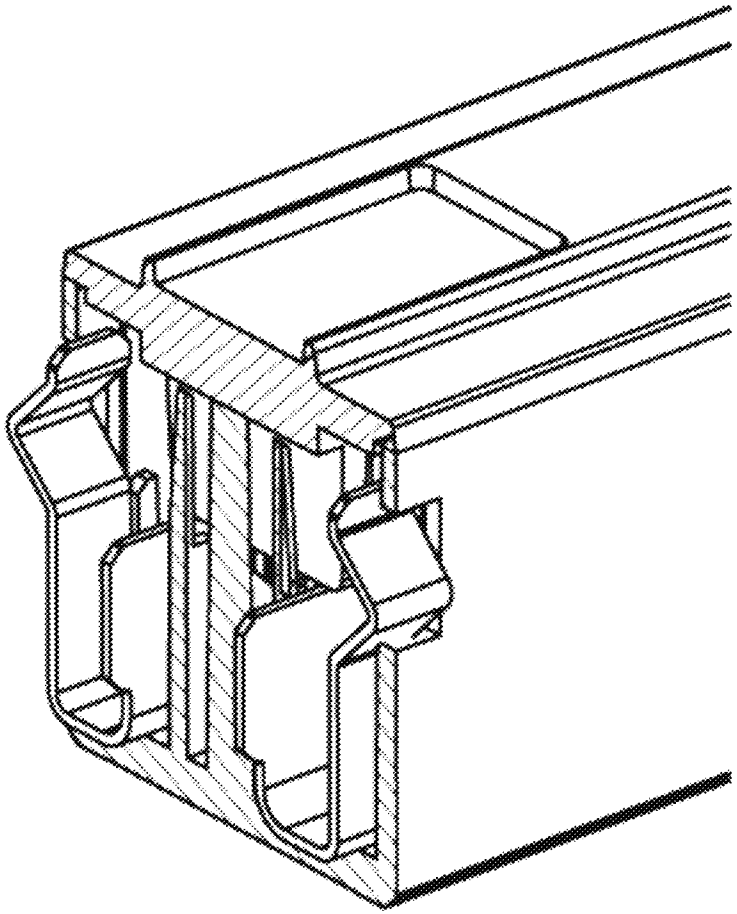
FIG. 10 shows a second partial three-dimensional view of the example in FIG. 8.
Figure 11:
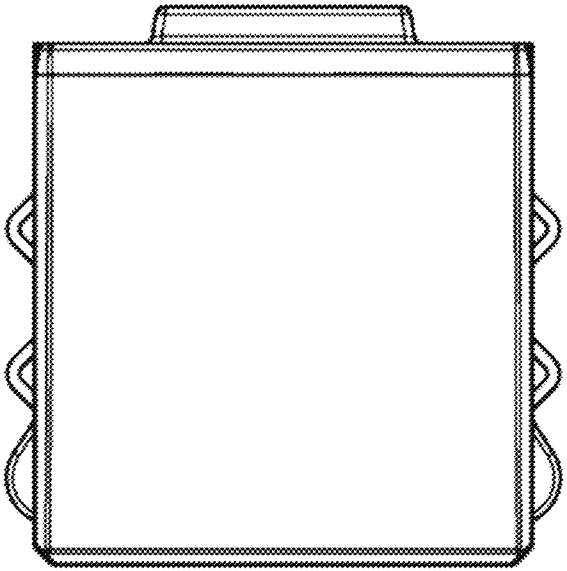
FIG. 11 shows a side view of the example in FIG. 8.
Figure 12:
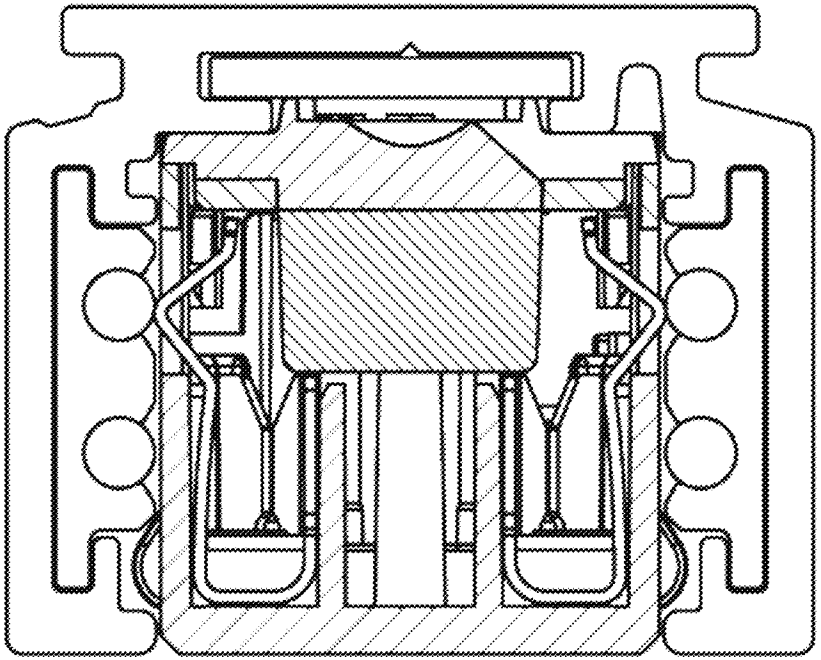
FIG. 12 shows a cross-section view of the example in FIG. 8 fully inserted into the groove of the guide of FIG. 7.

FIG. 8 and FIG. 9 and FIG. 10 show a first end zone of the connection body with two mechanical contacts (in particular, at the end) and two electrical contacts (in particular, spaced apart with respect to the end) both on the sides of the body (in particular, there is a mechanical contact and an electrical contact for each side); a second end zone may be similar to the first end zone, but the two electrical contacts of the second zone are in an offset position with respect to the two electrical contacts of the first zone (see FIG. 11); the mechanical contacts of the first zone and the second zone are in the aligned position (see FIG. 11) and can cooperate (see FIG. 12) with two small internal grooves of the guide, mentioned with reference to FIG. 6, located laterally in their front zone (bottom in the images of FIG. 7 and FIG. 12).

FIG. 12 shows (in the foreground) two electrical contacts which cooperate respectively with two electrical conductors of the guide and (in the background) two mechanical contacts which cooperate respectively with two internal grooves on the side of the guide. The other two electrical conductors of the guide may cooperate respectively with two electrical contacts of the connection body (not visible in the figure).

In FIG. 12, it is worth noting that the connection body is fully inserted into the groove of the guide and does not emerge at all; according to the alternative examples of embodiment, the body may protrude slightly from the guide, e.g. by up to a maximum of 10% or up to a maximum of 20%. Preferably, the connection body of this embodiment also comprises supply and/or control electronics; these electronics can, for example, generate appropriate electrical signals adapted to the light source or light sources of the lighting body and/or turn on the light source or light sources of the lighting body and/or adjust the brightness of the light source or sources of the lighting body.

Parts of the contacts, in particular the teeth of the contacts, emerge (in most protruding position) from the windows of the casing of the connection body (see FIG. 8); in this example, windows are provided both for mechanical contacts and for the electrical contacts; in particular, there is a small window for each contact.

The mechanical contacts are clearly shown in FIG. 9. Two contacts are integrated in a single "U"-shaped (symmetric) elastic element, in particular made of plastic material. In order to ensure the best elastic performance of contact, a spring (in particular, helical) is placed between the two arms of the "U" and acts so as to push the two arms away from each other. At each arm of the "U", there is a tooth shaped with two inclined surfaces (in particular, circular) to obtain the retraction of the tooth (and of the respective arm) following insertion of the body in the guide and the extraction of the body from the guide; the retraction derives from a force (in direction W) applied by an internal surface of the guide, in particular a shaped side surface of the groove, to an inclined surface of the tooth, and which derives from the insertion or extraction force (in direction P). The advancement of the tooth (and of the respective arm) following insertion of the body in the guide and the extraction of the body from the guide is obtained by virtue of the elastic reaction (in direction W) of the "U"-shaped element and of the spring.

The electrical contacts are clearly shown in FIG. 10. Two contacts are made by two "U"-shaped (asymmetric) elastic elements, in particular made of metallic material. At an arm of the "U", there is a tooth shaped with two inclined surfaces (in particular, which form a "V") to obtain the retraction of the tooth (and of the respective arm) following the insertion of the body in the guide and the extraction of the body from the guide; the retraction derives from a force (in direction W) applied by an internal surface of the guide, in particular a shaped side surface of the groove, to an inclined surface of the tooth, and which derives from the insertion or extraction force (in direction P). The advancement of the tooth (and of the respective arm) following insertion of the body in the guide and the extraction of the body from the guide is obtained by virtue of the elastic reaction (in direction W) of the "U"-shaped element.

From the above, it is apparent that the present invention is particularly adapted to be used for LED lighting systems (more generally, devices of the SSL type).

The possibility of inserting and extracting the apparatuses in direction perpendicular to the guides according to the present invention, as well as to the length of the body apparatuses themselves (i.e. these insertion and extraction operations occur by keeping body and guide parallel to each other and therefore without mutual rotations), is very advantageous because it makes both the positioning of the guide and the positioning and removal of the lighting apparatuses, as well as shape and size of the lighting apparatuses, totally free.

The invention claimed is:

1. A lighting apparatus comprising:

a connection body, and a lighting body with at least one light source;

wherein said lighting body is mechanically and electrically connected to said connection body, wherein said connection body is adapted for being mechanically and electrically connected to a supporting and power-supply guide that extends in a longitudinal direction (L), wherein said connection body is shaped like an elongated box and is adapted for being inserted into and extracted from said guide at least in a direction (P) perpendicular to the length thereof and to said longitudinal direction (L) keeping said connection body and said guide parallel to each other both in the insertion operation and in the extraction operation, and wherein said connection body comprises two mechanical contacts and two electrical contacts, and two elastic means acting on said two mechanical contacts or on said two electrical contacts so as to allow them to be moved back-and-forth due to the insertion into and the extraction from said guide;

wherein said two mechanical contacts and/or said two electrical contacts have inclined surfaces so that when said connection body moves towards or away from said guide and goes in contact with components of said guide, said contacts tend to move in a direction perpendicular to the back-and-forth direction and retract by application of a force to said connection body that is contrasted by said two elastic means that tend to return said contacts to a protruding position.

2. The lighting apparatus according to claim 1, wherein said connection body comprises four elastic means, wherein a first two of said four elastic means act on said two mechanical contacts so as to allow them to move back or forwards during the insertion into and extraction from said guide, and wherein a second two of said four elastic means act on said two electrical contacts so as to allow them to move back or forwards during the insertion into and extraction from said guide.

3. The lighting apparatus according to claim 1, wherein the elastic means and a mechanical or electrical contact are integrated so as to form a contact device.

4. The lighting apparatus according to claim 1, wherein the mechanical contacts and the electrical contacts are integrated so as to form mechanical and electrical contacts.

5. The lighting apparatus according to claim 1, wherein the connection body comprises sides and said electrical contacts and mechanical contacts are located on the sides of said connection body.

6. The lighting apparatus according to claim 1, wherein a first mechanical contact is located on a first side of said connection body, and wherein a second mechanical contact is located on a second side of said connection body.

7. The lighting apparatus according to claim 1, wherein the two electrical contacts are adapted for receiving electric power supply and wherein a second two electrical contacts are adapted for receiving electrical control signals.

8. The lighting apparatus according to claim 1, further comprising a magnet located at a back of said connection body.

9. The lighting apparatus according to claim 1, wherein said lighting body is mechanically and electrically connected to said connection body at a front of said connection body.

10. A power-supply apparatus comprising:

a connection body with an electric power supplier adapted for being electrically connected to an electric power-supply network;

wherein said connection body is adapted for being mechanically and electrically connected to a supporting and power-supply guide that extends in a longitudinal direction (L), wherein said connection body is shaped like an elongated box and is adapted for being inserted into and extracted from said guide at least in a direction (P) perpendicular to the length thereof and to said longitudinal direction (L) keeping said connection body and said guide parallel to each other both in the insertion operation and in the extraction operation, and wherein said connection body comprises two mechanical contacts and two electrical contacts, and two elastic means that act on said two mechanical contacts or on said two electrical contacts so as to allow them to move back-and-forth due to the insertion into and the extraction from said guide;

wherein said two mechanical contacts and/or said two electrical contacts have inclined surfaces so that when said connection body moves towards or away from said guide and goes in contact with components of said guide, said contacts tend to move in a direction perpendicular to the back-and-forth direction and retract by application of a force to said connection body that is contrasted by said two elastic means that tend to return said contacts to a protruding position.

11. The power-supply apparatus according to claim 10, wherein said connection body comprises four elastic means, wherein a first two of said four elastic means act on said two mechanical contacts so as to allow them to move back or forwards during the insertion into and extraction from said guide, and wherein a second two of said four elastic means act on said two electrical contacts so as to allow them to move back or forwards during the insertion into and extraction from said guide.

12. A coupling apparatus comprising:

a connection body with many electrical conductors for transferring electric power supply and/or electrical control signals;

wherein said connection body is adapted for being mechanically and electrically connected to a supporting and power-supply guide that extends in a longitudinal direction (L), wherein said connection body is shaped like an elongated box and is adapted for being inserted into and extracted from said guide at least in a direction (P) perpendicular to the length thereof and to said longitudinal direction (L) keeping said connection body and said guide parallel to each other both in the insertion operation and in the extraction operation, and wherein said connection body comprises two mechanical contacts and two electrical contacts, and two elastic means that act on said two mechanical contacts or on said two electrical contacts so as to allow them to move back-and-forth due to the insertion into and the extraction from said guide;

wherein said two mechanical contacts and/or said two electrical contacts have inclined surfaces so that when said connection body moves towards or away from said guide and goes in contact with components of said guide, said contacts tend to move in a direction perpendicular to the back-and-forth direction and retract by application of a force to said connection body that is contrasted by said two elastic means that tend to return said contacts to a protruding position.

13. The coupling apparatus according to claim 12, wherein said connection body comprises four elastic means, wherein a first two of said four elastic means act on said two mechanical contacts so as to allow them to move back or forwards during the insertion into and extraction from said guide, and wherein a second two of said four elastic means act on said two electrical contacts so as to allow them to move back or forwards during the insertion into and extraction from said guide.

14. A lighting system comprising:

a supporting and power-supply guide, with a longitudinal groove, a power-supply apparatus comprising:

a connection body with an electric power supplier adapted for being electrically connected to an electric power-supply network;

wherein said connection body is adapted for being mechanically and electrically connected to a supporting and power-supply guide that extends in a longitudinal direction (L), wherein said connection body is shaped like an elongated box and is adapted for being inserted into and extracted from said guide at least in a direction (P) perpendicular to the length thereof and to said longitudinal direction (L), and wherein said connection body comprises two mechanical contacts and two electrical contacts, and two elastic means that act on said two mechanical contacts or on said two electrical contacts so as to allow them to move back-and-forth due to the insertion into and the extraction from said guide, and at least one lighting apparatus according to claim 1;

wherein the connection body of said lighting apparatus and the connection body of said power-supply apparatus are adapted for being inserted in the groove of said guide.

15. The lighting system according to claim 14, wherein said guide has an inner shape comprising said groove and an outer shape, and wherein said outer shape is independent from said inner shape.

16. The power-supply apparatus according to claim 10, wherein the elastic means and a mechanical or electrical contact are integrated so as to form a contact device.

17. The power-supply apparatus according to claim 10, wherein the mechanical contacts and the electrical contacts are integrated so as to form mechanical and electrical contacts.

18. The power-supply apparatus according to claim 10, wherein the two electrical contacts are adapted for receiving electric power supply and wherein a second two electrical contacts are adapted for receiving electrical control signals.

19. The coupling apparatus according to claim 12, wherein the elastic means and a mechanical or electrical contact are integrated so as to form a contact device.

20. The coupling apparatus according to claim 12, wherein the mechanical contacts and the electrical contacts are integrated so as to form a mechanical and electrical contacts.

* * * * *